US005503098A

United States Patent [19]

Bohlin

[11] Patent Number: 5,503,098

[45] Date of Patent: Apr. 2, 1996

[54] AIR-PURGING DEVICE FOR HYDRAULIC BOAT STEERING ARRANGEMENTS

[75] Inventor: Stig Bohlin, Gothenburg, Sweden

[73] Assignee: AB Volvo Penta, Gothenburg, Sweden

[21] Appl. No.: 146,031

[22] PCT Filed: May 26, 1992

[86] PCT No.: PCT/SE92/00354

§ 371 Date: Nov. 9, 1993

§ 102(e) Date: Nov. 9, 1993

[87] PCT Pub. No.: WO92/21559

PCT Pub. Date: Dec. 10, 1992

[30] Foreign Application Priority Data

May 28, 1991 [SE] Sweden ..... 9101616

[51] Int. Cl.[6] ..... B63H 25/12

[52] U.S. Cl. ..... 114/150; 60/453

[58] Field of Search ..... 114/150; 440/61; 60/453, 378

[56] References Cited

U.S. PATENT DOCUMENTS

| | | | |
|---|---|---|---|
| Re. 33,043 | 9/1989 | McBeth | 60/327 |
| 3,958,420 | 5/1976 | Yokota | 60/453 |
| 4,449,470 | 5/1984 | Rump | 440/61 |

FOREIGN PATENT DOCUMENTS

| | | | |
|---|---|---|---|
| 0149893 | 9/1983 | Japan | 114/150 |

*Primary Examiner*—Sherman Basinger
*Attorney, Agent, or Firm*—Young & Thompson

[57] ABSTRACT

A device for purging marine hydraulic steering systems containing a hydraulic pump actuated by a boat steering-wheel and having first and second fluid inlet/outlet ports, a hydraulic piston cylinder device with first and second chambers on either side of the piston and first and second hydraulic conduits between the inlet/outlet ports of the pump and corresponding inlet/outlet ports to the respective chambers. A valve unit can be coupled into the respective connection between the inlet/outlet port of the respective chamber and the inlet/outlet port of the pump, via which valve unit air in the fluid can be released. The valve unit (8) has manually operated purging valves (33, 34), by which the respective chamber (12, 13) can be coupled to a third conduit (26) which opens into an inlet (5) of a fluid receptacle (1). The valve unit (8) has a valve housing (20) which has first and second channels (21, 22), which connect the first and second hydraulic conduits (6, 7) to the respective chambers (12, 13), and passages (23, 24) which connect the first and second channels to an outlet channel (25) to the third conduit (26). The valve unit contains the manually operated valves (33, 34), and a pair of purging screws (31, 32) each screwed into an individual bore (27, 28) in each passage (23, 24) and each provided with one of the valves (33, 34) respectively, which when the screw is completely screwed in breaks the connection between the first channel (21) and the outlet channel (25) or between the second channel (22) and the outlet channel (25) respectively.

6 Claims, 1 Drawing Sheet

AIR-PURGING DEVICE FOR HYDRAULIC BOAT STEERING ARRANGEMENTS

FIELD OF THE INVENTION

The present invention relates to a device for purging marine hydraulic steering systems of the type containing a hydraulic pump actuated by the boat steering-wheel and having first and second fluid inlet/outlet ports, a hydraulic piston cylinder device with first and second chambers on either side of the piston and first and second hydraulic conduits between the inlet/outlet ports of the pump and corresponding inlet/outlet ports of the respective chambers, said device comprising a valve unit which can be coupled into the respective connection between the inlet/outlet port of the respective chamber and the inlet/outlet port of the pump, via which valve unit the air in the fluid can be released.

BACKGROUND OF THE INVENTION

Hydraulic steering arrangement for boats are usually purged in the same manner as brake systems in automobiles for example, by opening purging nipples on the hydraulic cylinders and pressurizing the cylinder. In systems with air in the fluid, the air passes through the nipple first mostly air and some of fluid and finally fluid alone, whereafter the nipples close. Such purging methods which usually require two people (one "pumping" and one opening and closing the purging nipple) present special problems for marine steering arrangements. In view of the fact that marine steering arrangements of this type have the hydraulic cylinder mounted near the boat rudder shaft, which is in general mounted behind the engine or in any case near the rear portion of the engine, the job of collecting oil purged with the air will be difficult.

THE KNOWN PRIOR ART

U.S. Pat. No. Re. 33,043 for example discloses a device which eliminate the above mentioned problems. The known device comprises a system of non-return valves, a throttle valve and a collecting container, which is integrated into one unit. Via quick-couplings in the conduits between the steering wheel pump and the hydraulic cylinder it can be coupled as a shunt over the cylinder. The device makes it possible for one person to perform purging by merely turning the steering wheel. The pressure difference thereby produced is used in the valve system to purge liquid with air into the receptacle. After purging has been completed, the device can be disconnected whereupon automatic valves close the branch connections in the conduits between the pump and the cylinder.

The device described solves without a doubt the problems associated with conventional purging, but is on the other hand expensive and complicated and therefore not suitable to be permanently installed in simpler types of hydraulic steering systems. The known device is primarily suited for use in connection with service, i.e. when filling and purging the hydraulic systems.

OBJECT OF THE INVENTION

The purpose of the present invention is to provide a purging device of the type described by way of introduction which, at the same time as it eliminates the problem of fluid spillage during purging, is so inexpensive and uncomplicated that it can be permanently installed in the hydraulic system.

SUMMARY OF THE INVENTION

This is achieved according to the invention by virtue of the fact that the valve unit has manually operated purging valve means, by means of which the respective chamber can be coupled to a third conduit which opens into an inlet of a fluid receptacle.

In a particularly advantageous embodiment of the invention, the third conduit is at least partially transparent and leads to the pump of the hydraulic system.

The purging device according to the invention is uncomplicated and can be manufactured at substantially lower cost than the known device described above. Purging can be performed simply by one person and the risk of fluid spillage is entirely eliminated. The purging is performed by first opening a purging valve and thereafter turning the steering wheel in that direction which will reduce the volume in the associated chamber. When fluid without air bubbles can be seen to rise in the third conduit, the open valve is closed and the other valve is opened, whereafter the steering wheel is turned in the opposite direction until fluid without air bubbles again can be observed in the third conduit.

BRIEF DESCRIPTION OF THE DRAWING

The invention will be described below in more detail with reference to an example shown in the accompanying drawing, where.

DETAILED DESCRIPTION OF THE INVENTION

Figure 1:
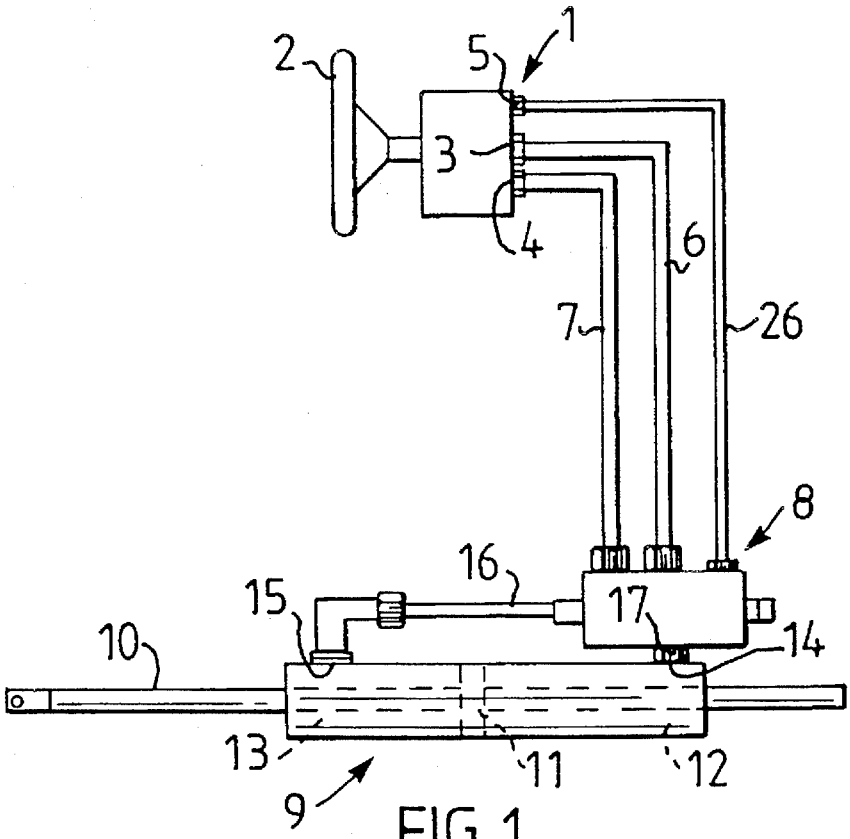
FIG. 1 shows a schematic sideview of a marine hydraulic steering system with a purging device and FIG. 2 is a longitudinal section through a valve unit in the purging device.

In FIG. 1, 1 generally designates a hydraulic pump, on the pump shaft of which a steering wheel 2 is mounted. The pump 1 has two inlet/outlet ports 3, 4 for connection to a hydraulic steering circuit and an inlet 5 for filling hydraulic fluid into the steering circuit. The pump 1 is previously known in its entirety and therefore need not be described in more detail here. The pump is connected via hydraulic conduits 6 and 7 and a valve unit (generally designated 8) to a hydraulic piston cylinder device with a piston rod 10, intended to be connected to a steering arm on a rudder shaft (not shown). A piston 11 divides the interior of the cylinder into two chambers 12, 13 with individual inlet/outlet ports 14 and 15 respectively, which communicate with the valve unit 8 via a connecting conduit 16 and a pipe stub 17 respectively, which is screwed into a threaded portion of the inlet/outlet port 14 and also serves as an anchoring element for mounting the valve unit on the hydraulic cylinder 9.

As the steering wheel 2 is turned in one direction, hydraulic fluid is pumped via the conduit 6 and the valve unit 8 into the chamber 12, and a corresponding amount of fluid is pumped from chamber 13 back into the pump via the conduit 7, when the piston 11 with the piston rod 10 is displaced to the left (FIG. 1). When the steering wheel 12 is turned in the opposite direction, fluid is pumped in the opposite direction and the piston 11 with the piston rod 10 is displaced to the right.

Figure 2:
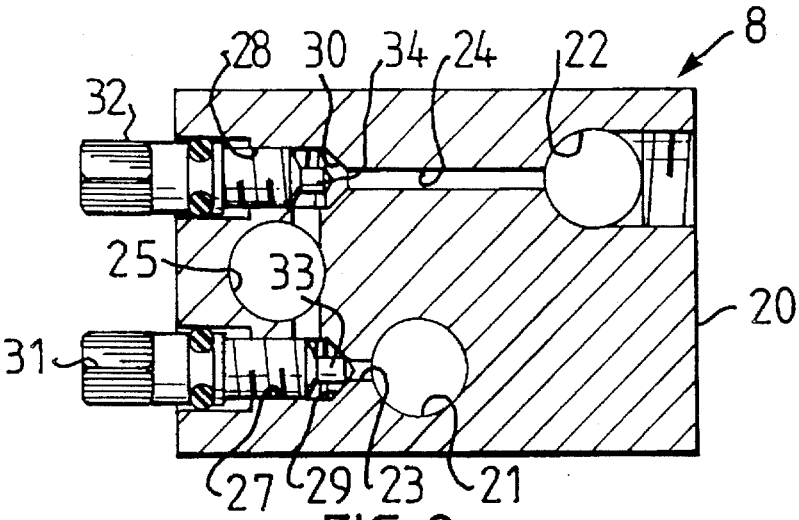

FIG. 2 shows a longitudinal section through a valve unit 8. The unit comprises a valve housing 20 containing a first straight through channel 21, to which the conduit 6 and the pipe stub 17 are connected and a second angle through channel 22, to which the conduit 7 and the connecting conduit 16 are connected. First and second passages 23 and 24 join the channels 21 and 22 respectively with a third channel 25, which is not a through-channel, and through which a third hydraulic conduit 26 (FIG. 1), preferably of transparent material at least in its upper portion, communicates with the filling port 5 of the pump. The passages 23, 24 open into threaded bores 27, 28 respectively provided with valve seats 29 and 30. A purging screw 31, 32 respectively is screwed into the respective bore 27, 28 and has at its inner end a valve body 33, 34 adapted to that of the seat 29, 30 respectively. FIG. 2 shows the valve unit 8 with the purging screw screwed out somewhat, so that a constricted communication is established between the channel 22 and the channel 25. When hydraulic fluid is now pumped into the chamber 12 via the channel 21, the connection of which with the channel 25 is broken by virtue of the fact that the purging screw 31 is screwed in completely, the air present in the chamber 13 will first be pumped out of the chamber and be conducted via the passage 24, the channel 25 and the conduit 26 into the pump. The ports 14, 15 from the chambers 12, 13 are located on the upper side of the cylinder 9 and the pump 1 is located at a level above the cylinder to assure that when there is air in the system, as little fluid as possible will be pumped out during the initial purging. When fluid with air bubbles and eventually pure fluid rises in the conduit 26, this can be observed by virtue of the fact that the conduit is transparent so that the operator can easily see when it is time to stop the purging. The chamber 12 is purged in a corresponding manner by screwing out the purging screw 31 after the screw 32 has been completely screwed in to seal the passage 24, whereafter the steering wheel is turned so that fluid is supplied to the chamber 13 via the conduit 7.

I claim:

1. In a device for purging marine hydraulic steering systems containing at hydraulic pump actuated by a boat steering-wheel and having first and second fluid inlet/outlet ports, a hydraulic piston cylinder device with first and second chambers on either side of the piston and first and second hydraulic conduits between the inlet/outlet ports of the pump and corresponding inlet/outlet ports to the respective chambers, said device comprising a valve unit, which can be coupled into the respective connection between the inlet/outlet port of the respective chamber and the inlet/outlet port of the pump, via which valve unit air in the fluid can be released, the valve unit (8) having manually operated purging valve means (33, 34), by means of which the respective chamber (12, 13) can be coupled to a third conduit (26) which opens into an inlet (5) of a fluid receptacle (1), the valve unit (8) comprising a valve housing (20) which has first and second channels (21, 22), which connect the first and second hydraulic conduits (6, 7) to the respective chambers (12, 13), and passages (23, 24) which connect the first and second channels to an outlet channel (25) to the third conduit (26), said valve unit containing the manually operated valve means (33, 34), and a pair of purging screws (31, 32) each screwed into an individual bore (27, 28) in each passage (23, 24) and each provided with a said valve means (33, 34) respectively, which when the screw is completely screwed in breaks the connection between the first channel (21) and the outlet channel (25) or between the second channel (22) and the outlet channel (25) respectively, said manually operated valve means (33, 34) being openable only by unscrewing said purging screws (31, 32).

2. Device according to claim 1, wherein the fluid receptacle is the pump (1) of the hydraulic system.

3. Device according to claim 1, wherein the third conduit (26) is transparent.

4. Device according to claim 1, wherein the valve unit (8) is made with means (14) for fixing the same directly onto the hydraulic cylinder (9).

5. Device according to claim 4 , wherein the valve unit housing (20) is fixed to the hydraulic cylinder (9) by means of a connecting nipple (17) screwed into the inlet/outlet port (14) of one of the chambers (12), the first channel opening into said nipple.

6. Device according to claim 5, wherein the second channel (22) is disposed at an angle relative to the first channel and opens into a conduit (16) connected to the inlet/outlet port (15) of the second chamber (13).

* * * * *